US012369704B2

(12) United States Patent
Gann

(10) Patent No.: US 12,369,704 B2
(45) Date of Patent: Jul. 29, 2025

(54) ACCESSORY LANYARD

(71) Applicant: MCP IP, LLC, Sparta, WI (US)

(72) Inventor: Brandon J. Gann, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 93 days.

(21) Appl. No.: 17/535,444

(22) Filed: Nov. 24, 2021

(65) Prior Publication Data

US 2022/0160116 A1 May 26, 2022

Related U.S. Application Data

(60) Provisional application No. 63/118,567, filed on Nov. 25, 2020.

(51) Int. Cl.
*A45F 5/02* (2006.01)
*A45F 5/00* (2006.01)

(52) U.S. Cl.
CPC ..... *A45F 5/00* (2013.01); *A45F 2005/006* (2013.01); *A45F 5/1566* (2025.01)

(58) Field of Classification Search
CPC ..... A45F 2005/006; A45F 2005/008; A45F 5/021; A45F 2003/002; A45F 2003/006; A45C 2013/303; Y10T 24/1374; Y10T 24/1368; A44D 2203/11
See application file for complete search history.

(56) References Cited

U.S. PATENT DOCUMENTS

| | | | | |
|---|---|---|---|---|
| 3,741,376 | A * | 6/1973 | Brown | A45F 5/02 224/183 |
| 4,442,559 | A * | 4/1984 | Collins | B26B 29/02 7/158 |
| 5,349,753 | A * | 9/1994 | Gaffney | B26B 1/00 24/166 |
| 5,427,259 | A * | 6/1995 | Krastanov | A61J 9/0638 248/104 |
| 5,682,653 | A * | 11/1997 | Berglof | G09F 1/10 224/183 |
| 6,216,319 | B1 * | 4/2001 | Elkins | A45F 5/00 224/904 |
| 6,616,274 | B1 * | 9/2003 | Sabia | G02C 11/00 351/63 |
| 7,000,809 | B1 * | 2/2006 | Stroud | F21L 4/005 224/250 |
| 8,408,513 | B2 | 4/2013 | Smith | |
| 9,167,329 | B2 * | 10/2015 | Honeycutt | H04R 1/1033 |
| 9,492,004 | B1 * | 11/2016 | Young | A45F 5/00 |
| 9,510,655 | B2 * | 12/2016 | Stratton | A45C 11/00 |
| 10,413,047 | B2 * | 9/2019 | Albanese | A45C 13/30 |
| 10,455,306 | B2 * | 10/2019 | Honeycutt | H04R 29/001 |
| 10,631,599 | B2 | 4/2020 | Bloch | |
| 11,317,701 | B2 | 5/2022 | Beckhart | |
| 11,570,540 | B2 * | 1/2023 | Honeycutt | H04R 1/1033 |
| 2002/0030071 | A1 | 3/2002 | Griffiths | |

(Continued)

*Primary Examiner* — Adam J Waggenspack
(74) *Attorney, Agent, or Firm* — Laabs Intellectual Property

(57) ABSTRACT

In some embodiments, a lanyard comprises a body comprising a first end, a midportion and a second end. A first engaging member and a second engaging member are magnetically attracted to one another. The first end comprises a handle and the first engaging member. The second end is configured for attachment to a device.

18 Claims, 12 Drawing Sheets

(56) References Cited

U.S. PATENT DOCUMENTS

| | | | | |
|---|---|---|---|---|
| 2004/0079843 | A1* | 4/2004 | Medwed | A61J 9/0661 248/104 |
| 2006/0032877 | A1 | 2/2006 | Obolo | |
| 2006/0282993 | A1 | 12/2006 | Dietz | |
| 2007/0099681 | A1* | 5/2007 | Kielland | A45F 5/021 455/575.1 |
| 2008/0061091 | A1* | 3/2008 | Mailliard | A45F 5/02 224/257 |
| 2008/0134474 | A1* | 6/2008 | Uryasov | B43K 23/001 24/303 |
| 2009/0095039 | A1* | 4/2009 | Nagamine | A45F 5/00 70/456 R |
| 2010/0083699 | A1* | 4/2010 | Conigliaro | A45F 5/02 24/303 |
| 2010/0116955 | A1* | 5/2010 | Hayes | B29C 39/26 248/206.5 |
| 2010/0152635 | A1 | 6/2010 | Borden | |
| 2012/0102623 | A1* | 5/2012 | Wiles | A45F 5/021 2/221 |
| 2013/0340477 | A1* | 12/2013 | Stachowski, Jr. | A44C 5/0053 63/3 |
| 2017/0328388 | A1 | 11/2017 | Salvatore | |
| 2020/0310156 | A1* | 10/2020 | Lin | G02C 3/04 |
| 2021/0074450 | A1* | 3/2021 | Harris, Sr. | H01R 31/06 |

* cited by examiner

ACCESSORY LANYARD

CROSS-REFERENCE TO RELATED APPLICATIONS

This application claims the benefit of U.S. Patent Application No. 63/118,567, filed Nov. 25, 2020, the entire content of which is hereby incorporated herein by reference.

BACKGROUND OF THE INVENTION

This invention relates generally to handles and more specifically to lanyards that can be attached to various devices.

People carry a variety of devices on their person and in their pockets daily. Some devices include pocket clips, such as flashlights, pocket knives, etc. A pocket clip can have benefits, such as positioning the device to be accessible, but there are also drawbacks. A pocket clip can damage and cause wear to material that forms the pocket and surrounding structure. A pocket clip can also cause the device to be visible to others, rather than being fully concealed in the pocket.

There remains a need for novel devices that provide improvements over prior art configurations.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

In some embodiments, a lanyard comprises a body comprising a first end, a midportion and a second end. A first engaging member and a second engaging member are magnetically attracted to one another. The first end comprises a handle and the first engaging member. The second end is configured for attachment to a device.

In some embodiments, the body comprises a tension material. In some embodiments, the tension material comprises a first segment and a second segment. The first segment extends from the first end to the second end and the second segment extends from the first end to the second end.

In some embodiments, a nonmetallic cover is positioned over the first engaging member. In some embodiments, a nonmetallic cover is positioned over the second engaging member.

In some embodiments, the second end comprises a loop. In some embodiments, the handle and the first engaging member are sized and arranged to pass through the loop. In some embodiments, the second engaging member is arranged to pass through the loop.

In some embodiments, a lanyard comprises a body comprising a first end, a midportion and a second end. The first end comprises a handle. The second end is configured for attachment to a device. The midportion comprises a magnet. The midportion is arranged to have greater stiffness than the second end.

In some embodiments, a reinforcing member is arranged to surround the midportion and the magnet.

In some embodiments, a lanyard comprises a body comprising a tension material. The body comprises a first end, a midportion and a second end. The first end comprises a first magnet, the midportion comprises a second magnet. The second end comprises a loop of said tension material.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
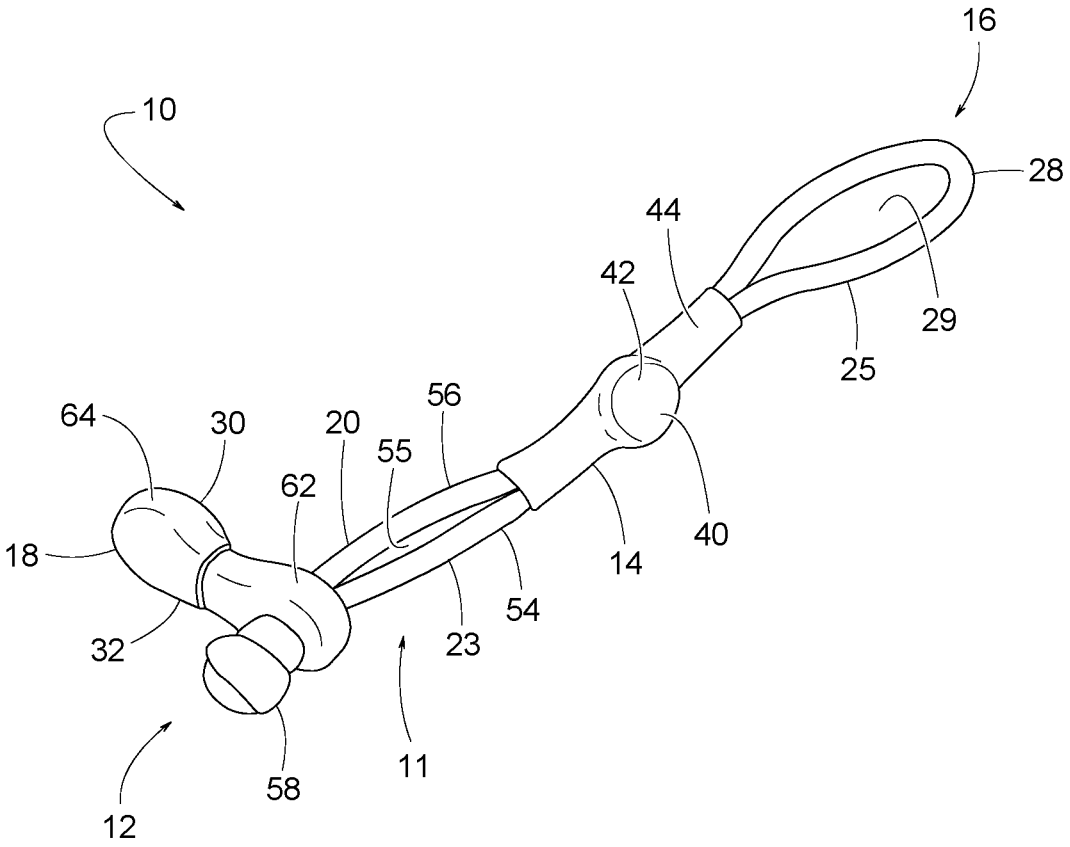
FIG. 1 shows an embodiment of a lanyard.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
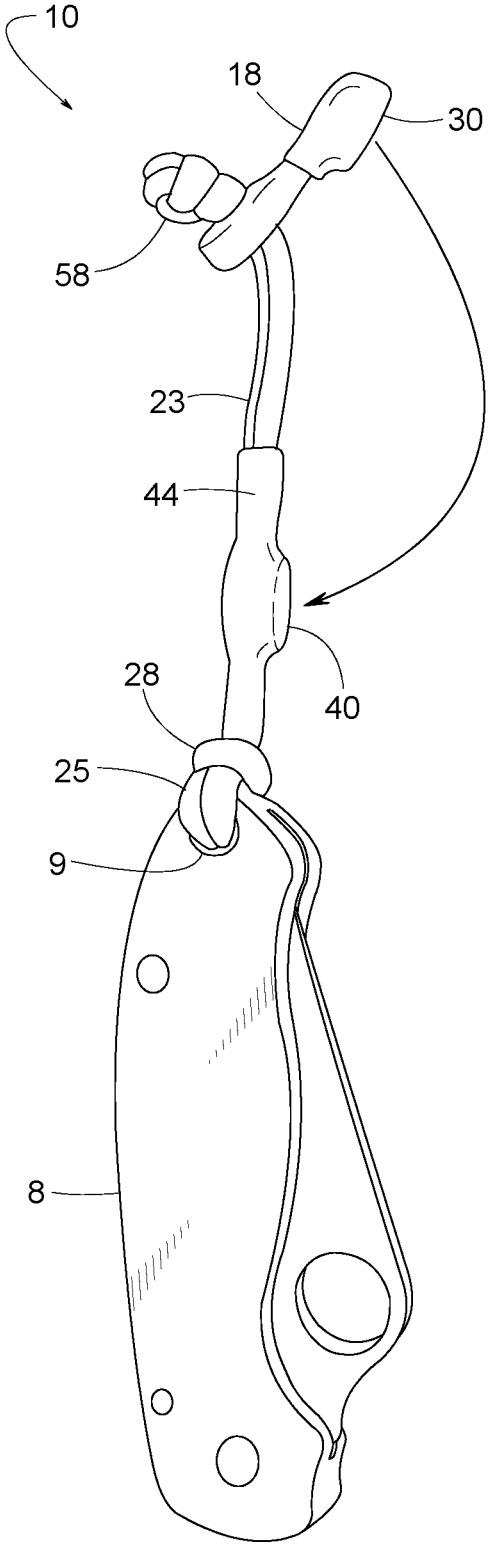
FIGS. 2 and 3 show an embodiment of a lanyard attached to a knife.

FIG. 1 shows an embodiment of a lanyard 10 suitable for attachment to a device such as a pocket knife, flashlight or any other suitable device. FIG. 2 shows an embodiment of a lanyard 10 in a first orientation and FIG. 3 shows an embodiment of the lanyard 10 in a second orientation.

Figure 3:
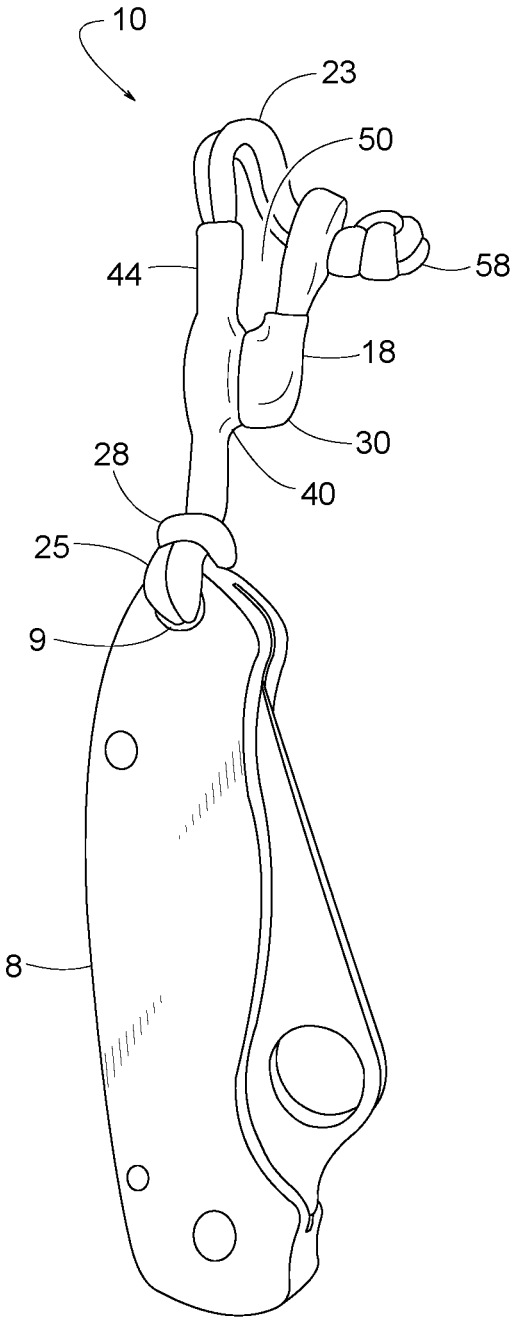

Referring to FIGS. 1-3, in some embodiments, a lanyard 10 comprises a body 11 comprising a first end portion 12, a midportion 14 and a second end portion 16. In some embodiments, the second end portion 16 is configured for attachment to a device. In some embodiments, the first end portion 12 comprises a handle 18.

In some embodiments, the lanyard 10 comprises a first engaging member 30 and a second engaging member 40. In some embodiments, the first engaging member 30 and the second engaging member 40 are spaced apart from one another along the length of the lanyard 10. In some embodiments, the first end portion 12 comprises the first engaging member 30 and the midportion 14 comprises the second engaging member 40. Desirably, the first engaging member 30 is arranged to engage and become attached to the second engaging member 40. In some embodiments, the first engaging member 30 and the second engaging member 40 are magnetically attracted to one another. In some embodiments, one of the engaging members 30, 40 comprises a magnet and the other comprises a ferrous material such as steel, wherein the magnet is attracted to the ferrous material. In some embodiments, the first engaging member 30 comprises a magnet and the second engaging member 40 comprises a magnet.

In some embodiments, the body 11 comprises a tension material 20. In some embodiments, a tension material 20 comprises a flexible material capable of supporting a tensile load. In some embodiments, a tension material 20 comprises a strap, a cord, a fabric, a braided material or any other suitable material. In some embodiments, a tension material 20 comprises a flat strip or ribbon of material. In some embodiments, a tension material 20 comprises paracord, for example comprising a core layer and a braided cover layer.

In some embodiments, the tension material 20 comprises a first length portion 23 and a second length portion 25. In some embodiments, the first length portion 23 extends from the first end portion 12 to the midportion 14. In some embodiments, the second length portion 25 extends from the midportion 14 to the second end portion 16.

In some embodiments, the first length portion 23 comprises a first segment 54 and a second segment 56. In some embodiments, a cavity 55 is defined between the first segment 54 and the second segment 56.

In some embodiments, the second length portion 25 and/or the second end portion 16 comprises a loop 28. In some embodiments, a loop 28 defines a cavity 29.

In some embodiments, the body 11 comprises a length of material, such as a cord, that is folded in half. In some embodiments, the length of material defines a loop 28 at the second end portion 16 and comprises ends that are attached to one another at the first end 12. In some embodiments, the ends are tied in a knot 58.

In some embodiments, the handle 18 comprises a body comprising a first portion 62 and a second portion 64. In some embodiments, the first portion 62 is attached to the tension material 20. In some embodiments, the first portion 62 comprises an aperture and the tension material 20 extends through the aperture 20. In some embodiments, the second portion 64 comprises the first engaging member 30. In some embodiments, handle 18 comprises a narrowed waist portion 63 located between the first portion 62 and the second portion 64. In some embodiments, a size of the handle 18 increases as the body is traversed from the waist portion 63 toward the second portion 64, which can provide a structure for a user to grasp.

In some embodiments, a cover 32 is provided over the first engaging member 30. In some embodiments, a cover 32 comprises a nonmetallic material arranged to dampen or prevent sound from being audible went the engaging members 30, 40 contact one another. In some embodiments, a cover 32 comprises a heat-shrinking material. In some embodiments, a cover 32 comprises any suitable polymeric material. In some embodiments, a cover 32 comprises rubber or an elastomer.

In some embodiments, a cover 42 is provided over the second engaging member 40.

In some embodiments, a lanyard 10 comprises a reinforcing member 44. In some embodiments, a reinforcing member 44 provides support to the body 11. In some embodiments, a reinforcing member 44 provides support to the tension material 20. In some embodiments, the reinforcing member 44 increases the strength of the body 11 in resistance to bending along its length. In some embodiments, the reinforcing member 44 increases the strength of the body 11 in resistance to axial compression and buckling. In some embodiments, the reinforcing member 44 surrounds the body 11. In some embodiments, a reinforcing member 44 surrounds a first segment 54 and a second segment 56 of the tension material 20. In some embodiments, a reinforcing member 44 comprises a cover 42. In some embodiments, a reinforcing member 44 is nonmetallic. In some embodiments, a reinforcing member 44 comprises a heat-shrinking material. In some embodiments, a reinforcing member 44 provides the midportion 14 with a greater stiffness than an end 12, 16 of the lanyard 10.

In some embodiments, a lanyard 10 can be arranged to engage a device 8 using any suitable attachment configuration. In some embodiments, the second end portion 16 can be arranged to engage a device 8 using any suitable attachment configuration. In some embodiments, a fastener (not illustrated) is used to attach a lanyard 10 to a device 8.

In some embodiments, the second end portion 16 comprises a loop 28 configured for attachment to a device 8. For example, in some embodiments, a device 8 comprises a lanyard hole 9. In some embodiments, the second length portion 25 can be positioned through a lanyard hole 9 with the loop 28 located to a first side of the device 8 and the rest of the lanyard 10 oriented to a second side of the device 8. The body 11 can then be fed through the cavity 29. For example, the first end 12, engaging members 30, 40, and first length portion 23 can be passed through the cavity 29, thereby attaching the lanyard 10 to the device 8, for example as shown in FIGS. 2 and 3.

In some embodiments, a lanyard 10 comprises a first orientation where the first engaging member 30 is spaced apart from the second engaging member 40. See e.g. FIG. 2. In some embodiments, in the first orientation, the first engaging member 30 is not engaged with or attached to the second engaging member 40. In some embodiments, in the first orientation, the first engaging member 30 is spaced apart from the second engaging member 40 a sufficient distance that a magnetic force between the first engaging member 30 and the second engaging member 40 is too weak to cause movement of either engaging member 30, 40.

In some embodiments, the lanyard 10 comprises a second orientation where the first engaging member 30 is engaged with the second engaging member 40. See e.g. FIG. 3. In some embodiments, in the second orientation, the first engaging member 30 is magnetically attached to the second engaging member 40. In some embodiments, in the second orientation, the first engaging member 30 is directly adjacent to and magnetically engaged with the second engaging member 40.

In some embodiments, in the second orientation, the lanyard 10 comprises a cavity 50 that is closed about its perimeter. In some embodiments, the cavity 50 is closed when the engaging members 30, 40 engage one another.

Figure 4:
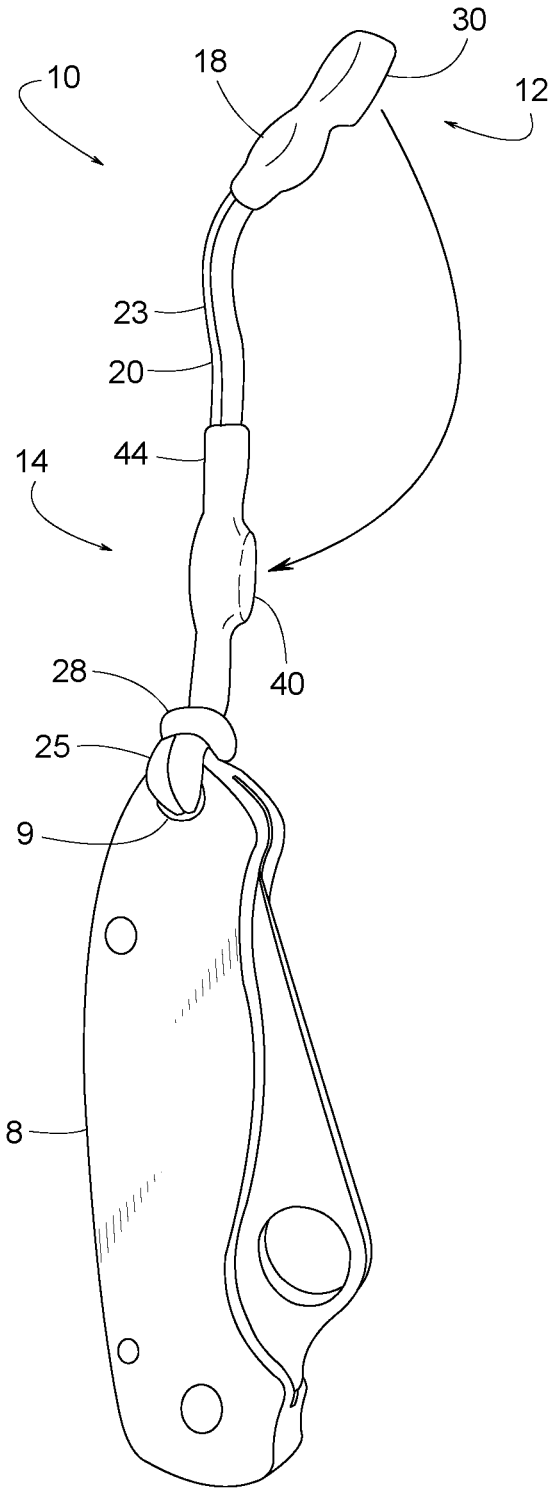
FIGS. 4 and 5 show another embodiment of a lanyard attached to a knife.
Figure 5:
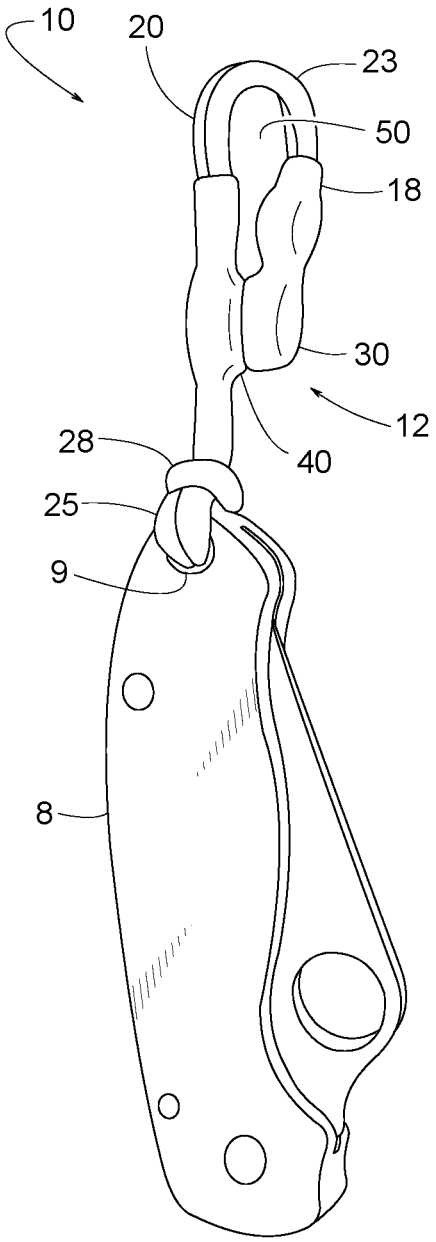

FIGS. 4 and 5 show another embodiment of a lanyard 10. In some embodiments, a handle 18 can be attached to a tension member 20 using any suitable configuration. In some embodiments, an adhesive is used. In some embodiments, the handle 18 comprises an internal cavity and the tension member 20 terminates in the internal cavity. In some embodiments, the tension member 20 comprises a first segment 54 and a second segment 56, and both segments 54, 56 terminate in the handle 18, for example in an internal cavity. In some embodiments, the handle 18 is formed by a process comprising molding, and the tension member 20 is insert molded in the handle 18. For example, a portion of the tension member 20 can be oriented in a mold cavity prior to the handle material being placed/injected in the mold cavity.

Figure 6:
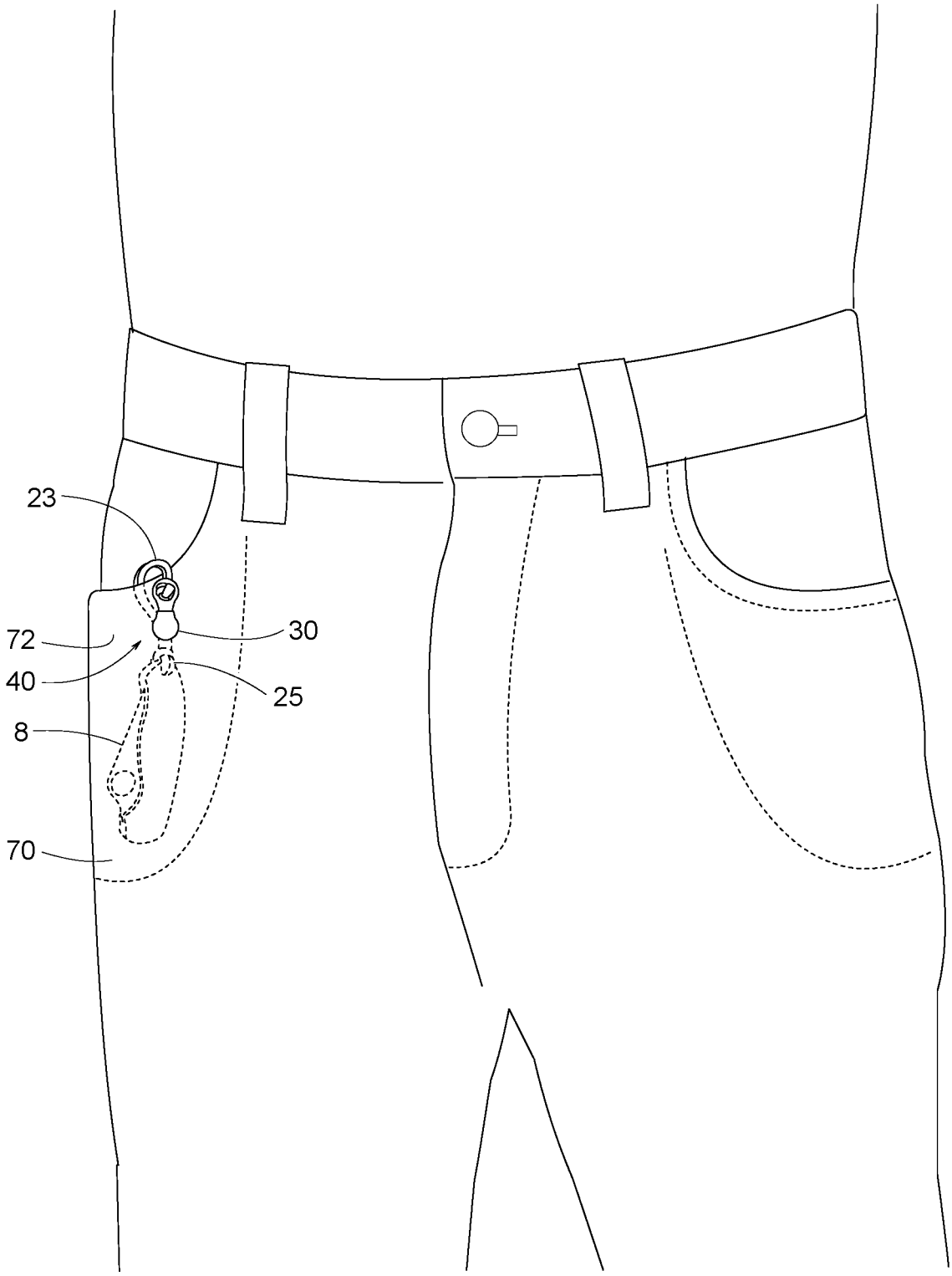
FIG. 6 shows an embodiment of a lanyard supporting a knife in a pocket.

FIG. 6 shows an embodiment of a lanyard 10 attached to a device 8. The lanyard 10 is arranged to support the device 8. The device 8 may be concealed, for example within a pocket 70. In some embodiments, the lanyard 10 engages a support 72 such as fabric that is proximate to or defining the pocket 70. In some embodiments, the support 72 is arranged to support the lanyard 10 and the lanyard 10 is arranged to support the device 8. In some embodiments, the device 8 is suspended by the lanyard 10. In some embodiments, the device 8 is not supported by any secondary support. For example, as shown in FIG. 6, the device 8 does not rest in the bottom of the pocket 70 but remains suspended in the pocket 70.

In some embodiments, at least a portion of the lanyard 10 is concealed within the pocket 70. In some embodiments, the first length portion 23 is oriented outside of the pocket 70 and the second length portion 25 is concealed within the pocket 70. In some embodiments, the first engaging member 30 is oriented outside the pocket 70 and the second engaging member 40 is oriented within the pocket 70. In some embodiments, the first engaging member 30 is oriented to a first side of a support 72 and the second engaging member 40 is oriented to a second side of the support 72 while the engaging members 30, 40 are magnetically engaged with one another. In some embodiments, the first side is opposite the second side. For example, in some embodiments, the first engaging member 30 is oriented outside of the pocket 70 and to a first side of the support 72, and the second engaging member 40 is oriented inside the pocket 70 an to a second side of the support 72.

In some embodiments, when the engaging members 30, 40 are magnetically engaged with one another and engaged to a support 72, the device 8 is considered attached to the support 72. In some embodiments, a support 72 comprises a nonferrous material.

Figure 7:
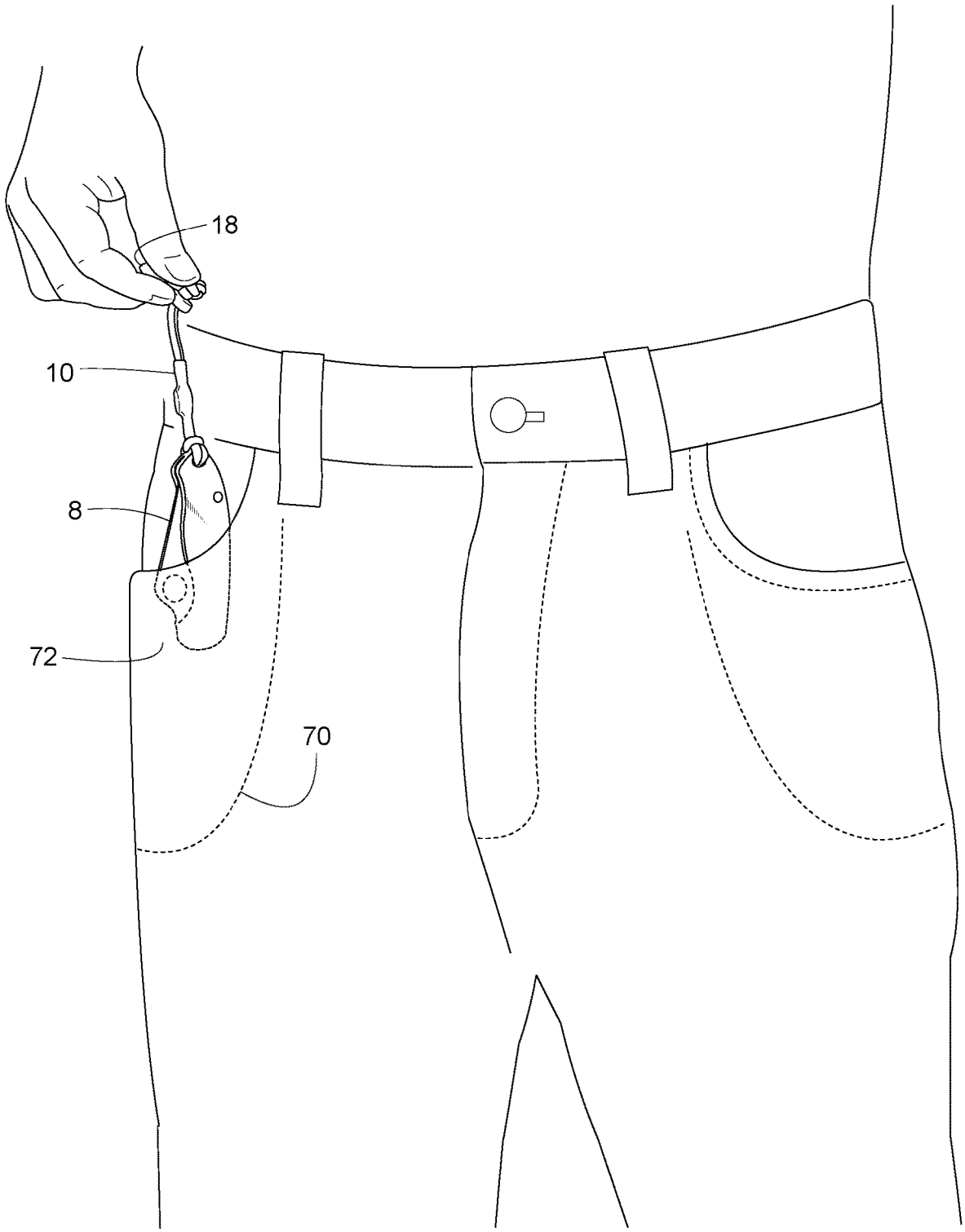
FIG. 7 shows an embodiment of a lanyard being disengaged from a pocket.

FIG. 7 shows an embodiment of a lanyard 10 being disengaged or detached from a support 72. In some embodiments, a handle 18 can be grasped and pulled by a user. Desirably, the force applied to the handle 18 is sufficient to overcome the engaging forces between the engaging members 30, 40. Thus, the user is able to disengage the first engaging member 30 from the second engaging member 40. The lanyard 10 is then considered disengaged from the support 72, and the device 8 can be removed from the pocket 70.

Figure 8:
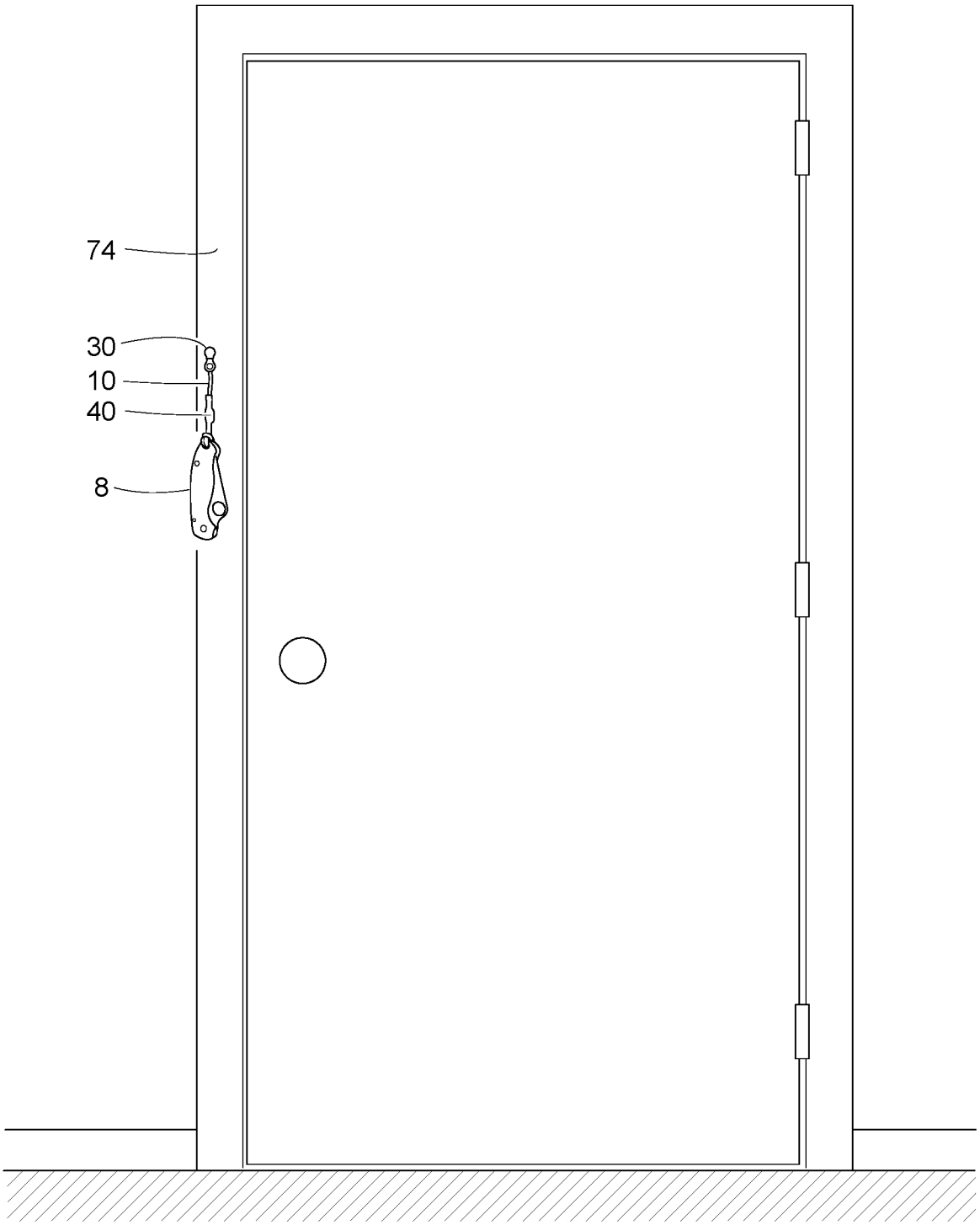
FIG. 8 shows an embodiment of a lanyard attached to an external support.

FIG. 8 shows an embodiment of a lanyard 10 engaged with a ferrous support 74, such as a metal door frame. In various embodiments, one or both of the engaging members 30, 40 comprises a magnet, and the magnet can be magnetically attracted to a ferrous support 74. In some embodiments, the lanyard 10 allows a device 8 to be attached to any suitable ferrous support 74.

Figure 9:
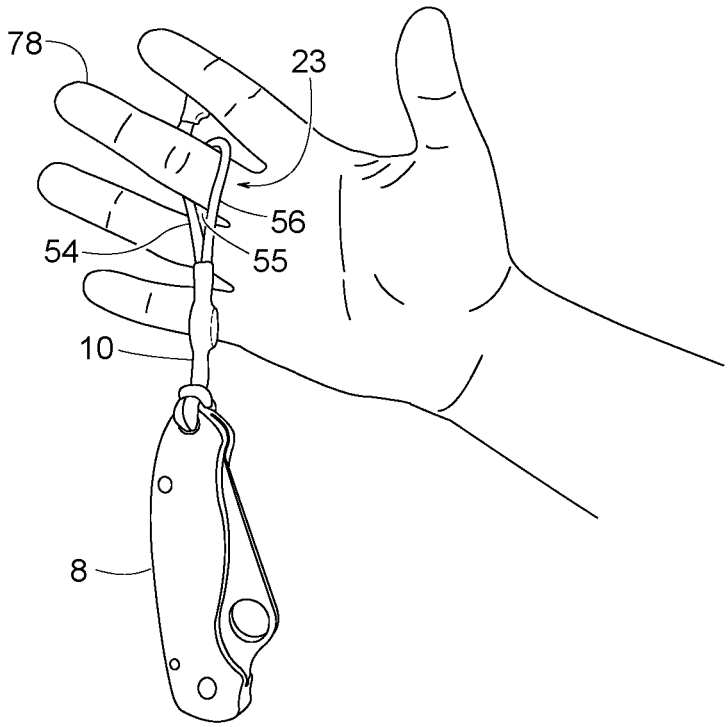
FIGS. 9-12 show embodiments of a lanyard in use.
Figure 10:
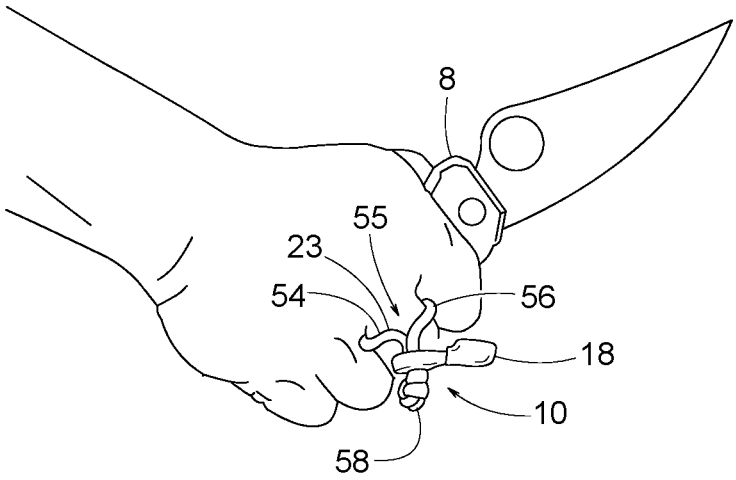
Figure 11:
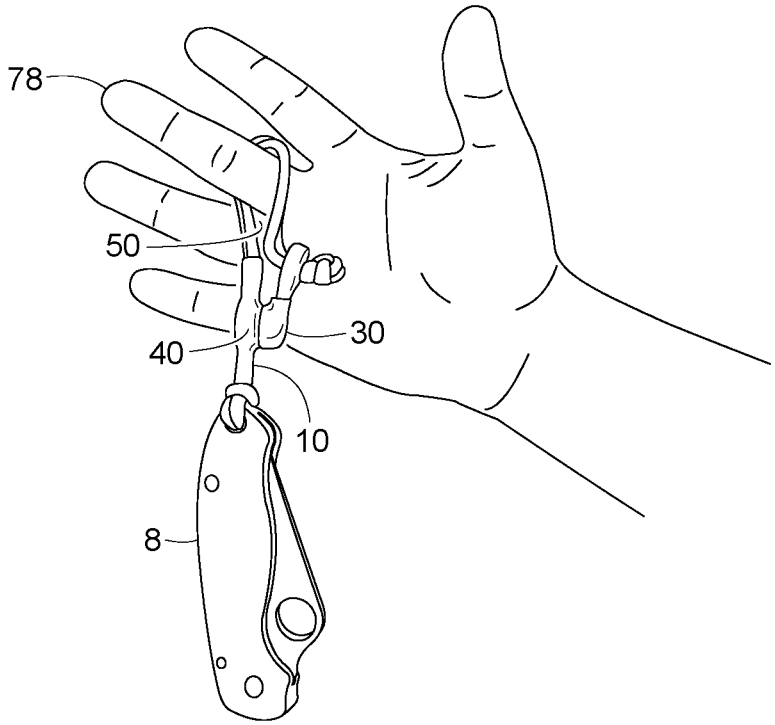
Figure 12:
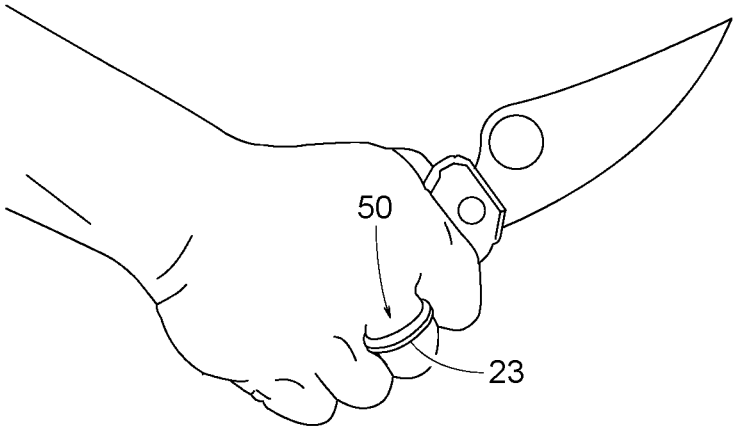

FIGS. 9-12 show different ways that a lanyard 10 can be engaged with a user's hand. In some embodiments, the lanyard 10 comprises a first length portion 23 comprising a first segment 54 adjacent to a second segment 56. A cavity 55 is defined between the first segment 54 and second segment 56. In some embodiments, a user's finger 78 can be oriented in the cavity 55 and secured to the lanyard 10 while the engaging members 30, 40 are not engaged with one another, for example as shown in FIGS. 9 and 10.

In some embodiments, the engaging members 30, 40 can be engaged with one another, forming the cavity 50, and the user's finger 78 can be oriented in the cavity 50.

Figure 13:
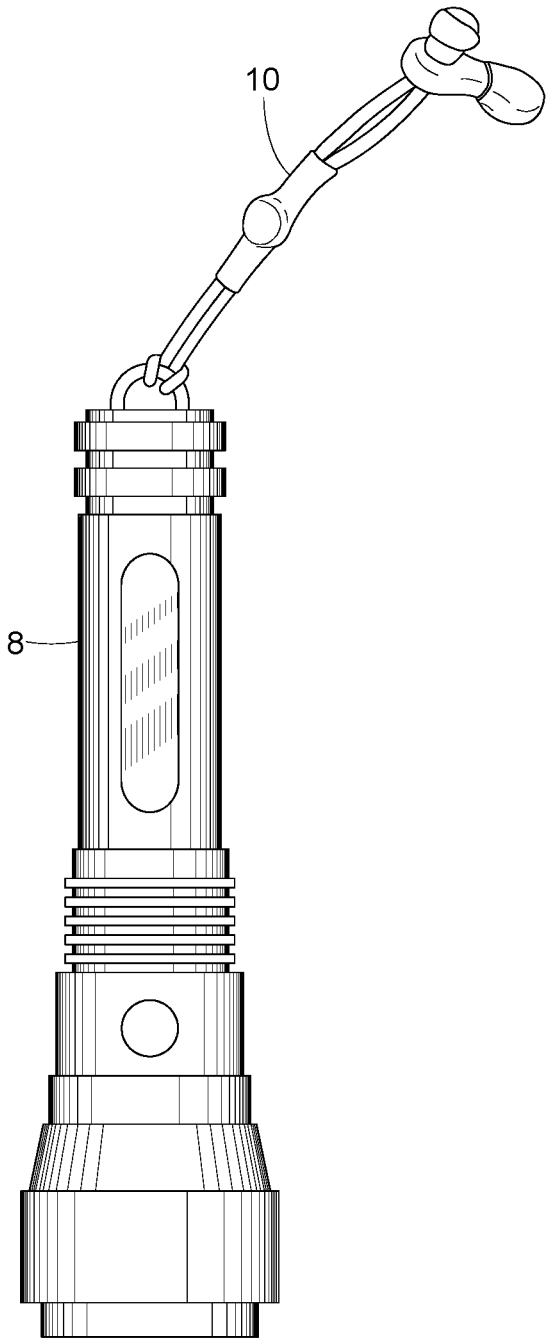
FIG. 13 shows an embodiment of a lanyard attached to a flashlight.
Figure 14:
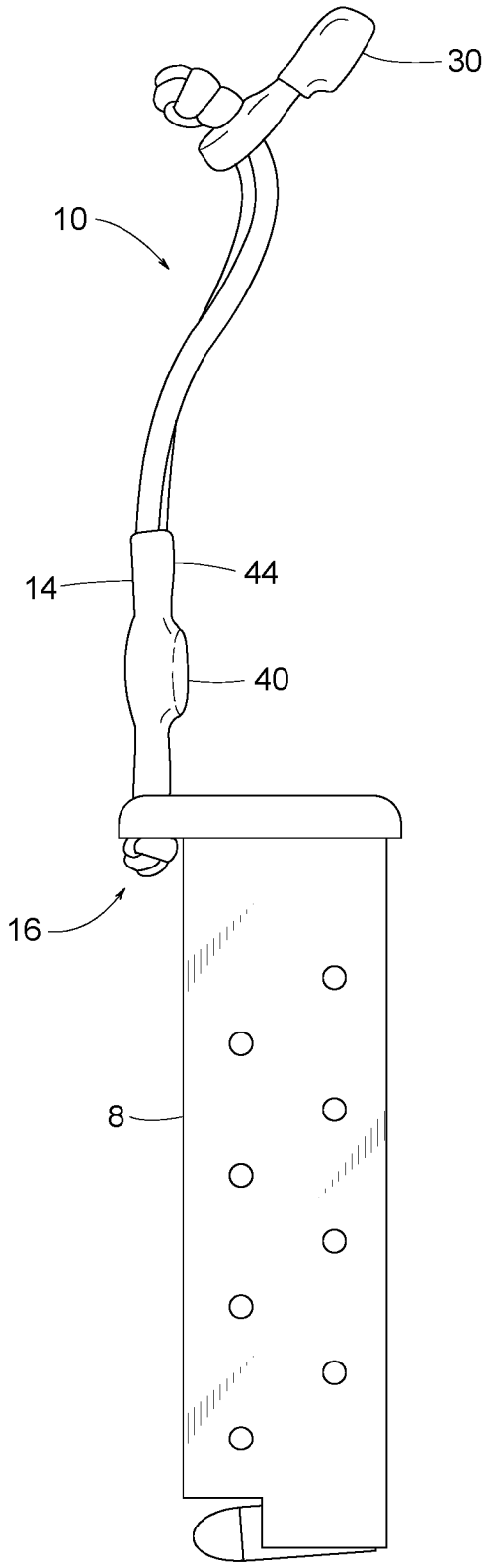
FIGS. 14-17 show embodiments of a lanyard attached to a firearm magazine.
Figure 15:
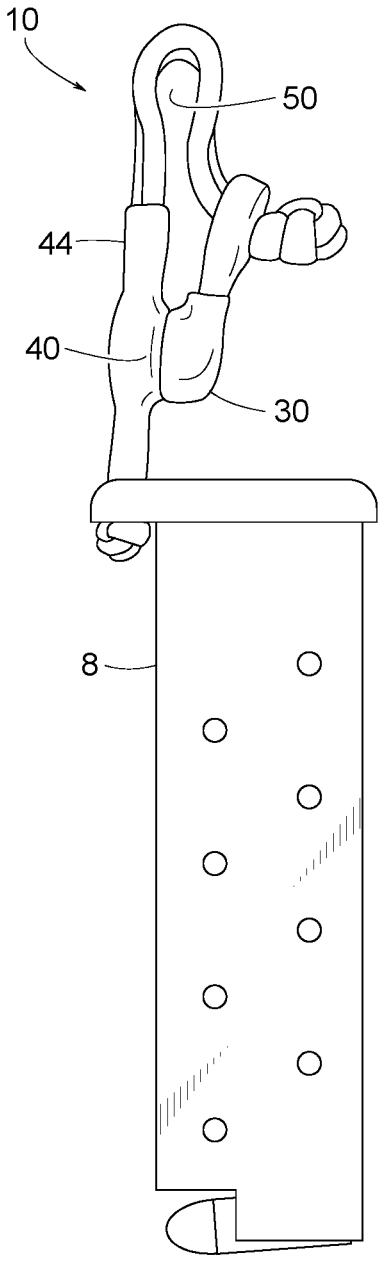
Figure 16:
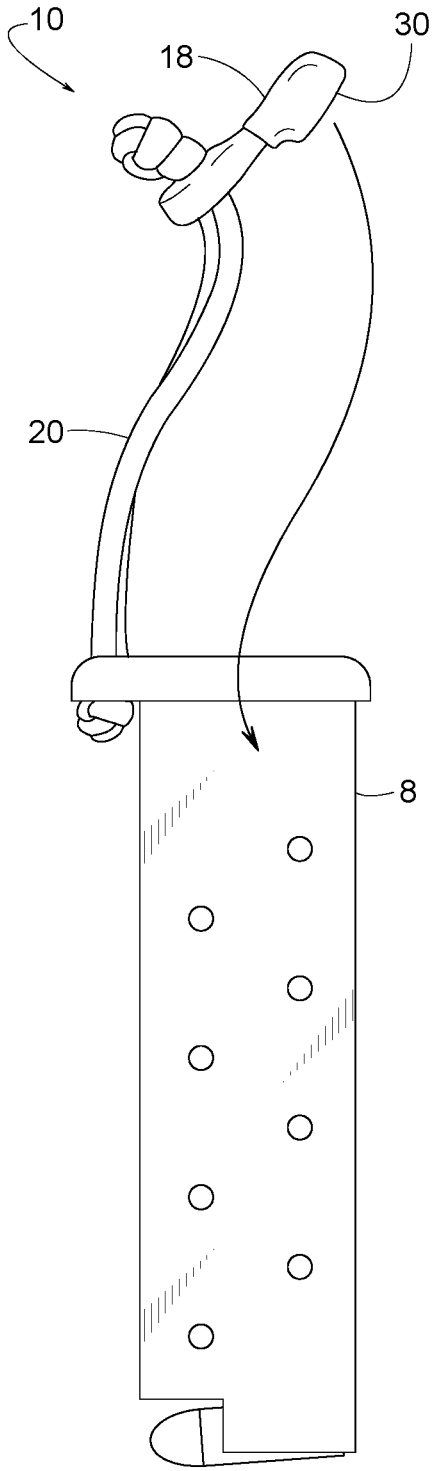
Figure 17:
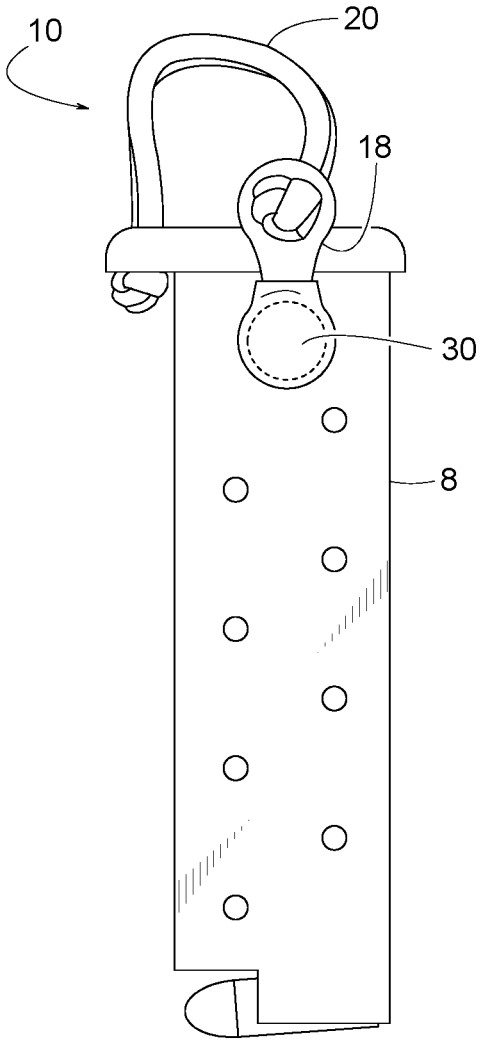

A lanyard 10 can be used with any suitable device 8. FIG. 13 shows a lanyard 10 engaged with a device 8 comprising a flashlight. FIGS. 14-17 show embodiments of a lanyard 10 engaged with a device 8 comprising a gun magazine. Thus, spare magazines can be supported by a lanyard 10. Also, a magazine can be oriented in a gun, such as a pistol, and the pistol can be hidden in a pocket. Thus, in some embodiments, a lanyard 10 is attached to a firearm.

Figure 18:
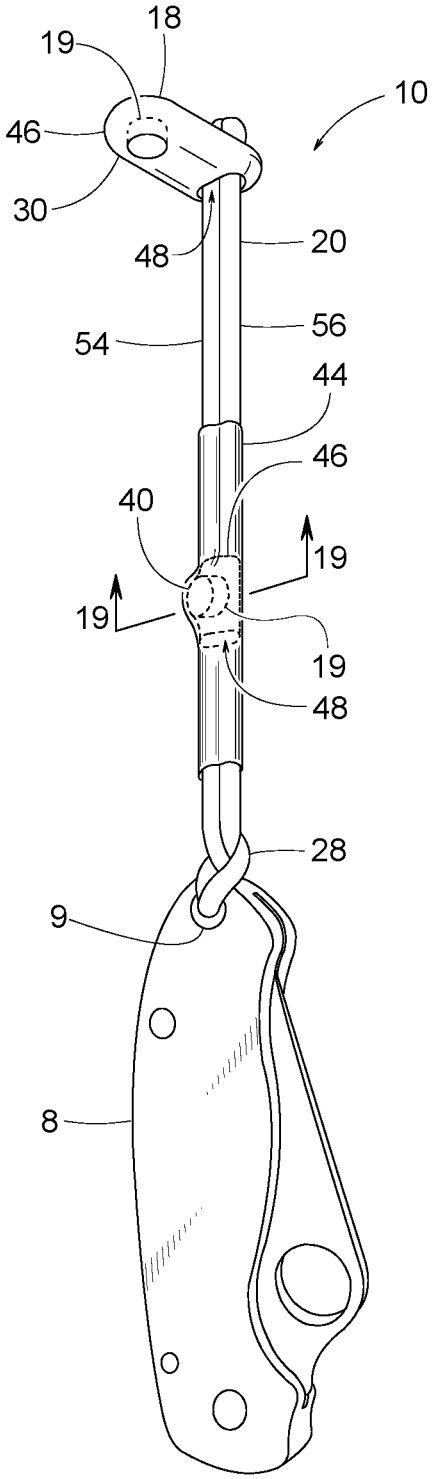
FIG. 18 shows another embodiment of a lanyard attached to a knife.
Figure 19:
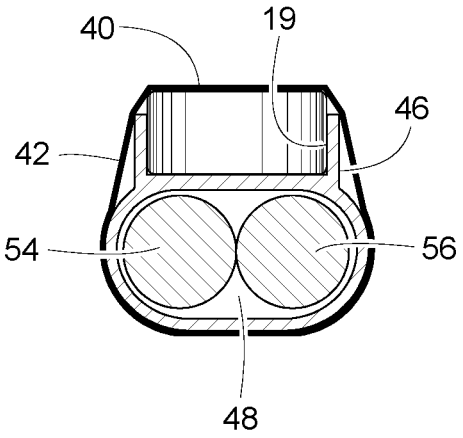
FIG. 19 shows a cross-sectional view of a portion of an embodiment of an accessory lanyard.

FIG. 18 shows another embodiment of a lanyard 10. FIG. 19 shows a cross-sectional view of a portion of the embodiment of the lanyard 10. In some embodiments, the handle 18 comprises a housing 46 for the first engaging member 30. In some embodiments, the handle 18 comprises a cavity 19 and the first engaging member 30 is oriented in the cavity 19. In some embodiments, an outer surface of the first engaging member 30 is flush with, or recessed below, an outer surface of the handle 18.

In some embodiments, the lanyard 10 comprises a housing 46 for the second engaging member 40. In some embodiments, a housing 46 comprises a cavity 19 and the second engaging member 40 is oriented in the cavity 19. In some embodiments, the housing 46 comprises an outer surface shaped to abut the tension material 20. In some embodiments, the housing 46 comprises an aperture 48 or tubular portion and the tension material 20 extends through the aperture 48. In some embodiments, a first segment 54 and a second segment 56 of the tension material 20 extend through the aperture 48. In some embodiments, a central axis of the cavity 19 is oriented orthogonal to a central axis of the aperture 48.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A lanyard comprising:

a body comprising a first end, a midportion and a second end, the body comprising a cord comprising a first cord end and a second cord end, the first cord end and the second cord end located at the first end, the cord oriented in a loop at the second end;

a first engaging member and a second engaging member magnetically attracted to one another;

the first end comprising a handle and the first engaging member, the second end attached to a pocket knife;

wherein the lanyard is constructed and arranged to allow the pocket knife and the second engaging member to be oriented inside a pocket and the handle and first engaging member oriented outside of the pocket, with the first engaging member magnetically engaging the second engaging member and a fabric defining the pocket located between the first engaging member and the second engaging member.

2. The lanyard of claim 1, the midportion comprising the second engaging member.

3. The lanyard of claim 1, the handle comprising a cavity, the first engaging member oriented in the cavity.

4. The lanyard of claim 1, the first cord end attached to the second cord end.

5. The lanyard of claim 4, the first cord end and the second cord end tied in a knot.

6. The lanyard of claim 1, the first engaging member comprising a magnet.

7. The lanyard of claim 6, the second engaging member comprising a ferrous material.

8. The lanyard of claim 6, the second engaging member comprising a magnet.

9. The lanyard of claim 1, comprising a nonmetallic cover positioned over the first engaging member.

10. The lanyard of claim 9, comprising a nonmetallic cover positioned over the second engaging member.

11. The lanyard of claim 1, the cord comprising a first segment adjacent to the handle and a second segment adjacent to the handle, the body comprising a cavity between the first segment and the second segment.

12. The lanyard of claim 1, wherein the handle and the first engaging member are sized and arranged to pass through the loop.

13. The lanyard of claim 12, wherein the second engaging member is arranged to pass through the loop.

14. A device comprising:

a body comprising a first end, a midportion and a second end, the body comprising a cord comprising a first cord end and a second cord end, the first cord end and the second cord end located at the first end;

the first end comprising a first magnet, the midportion comprising a second magnet;

the second end comprising a loop of said cord, the second end attached to a pocket knife.

15. The device of claim 14, the first end and midportion sized and arranged to pass through the loop.

16. The device of claim 14, the cord comprising a first segment and a second segment, the first segment extending from the first end to the second end, the second segment extending from the first end to the second end.

17. The device of claim 16, the loop comprising a portion of the first segment and a portion of the second segment.

18. The device of claim 14, wherein the device is constructed and arranged to allow the pocket knife and the second magnet to be oriented inside a pocket and the first magnet oriented outside of the pocket, with the first magnet magnetically engaging the second magnet and a fabric defining the pocket located between the first magnet and the second magnet.

* * * * *